US005423582A

United States Patent [19]

Kleefeldt

[11] Patent Number: 5,423,582

[45] Date of Patent: Jun. 13, 1995

[54] POWER-ASSIST MOTOR-VEHICLE DOOR LATCH

[75] Inventor: Frank Kleefeldt, Heiligenhaus, Germany

[73] Assignee: Kiekert GmbH & Co. KG, Heiligenhaus, Germany

[21] Appl. No.: 193,657

[22] Filed: Feb. 8, 1994

[30] Foreign Application Priority Data

Apr. 9, 1993 [DE] Germany ..... 43 11 786.4

[51] Int. Cl.[6] ..... E05C 3/26

[52] U.S. Cl. ..... 292/201; 292/DIG. 43

[58] Field of Search ..... 292/201, 341.15, 341.16, 292/DIG. 14, DIG. 42, DIG. 43

[56] References Cited

U.S. PATENT DOCUMENTS

| | | | |
|---|---|---|---|
| 2,725,248 | 11/1955 | Rimkus | 292/DIG. 43 |
| 3,580,623 | 5/1971 | Peters | 292/201 |
| 4,652,027 | 3/1987 | Quantz | 292/DIG. 43 |
| 4,892,339 | 1/1990 | Kleefeldt | 292/201 |
| 5,273,325 | 12/1993 | Zimmerman | 292/DIG. 43 |
| 5,288,115 | 2/1994 | Inoue | 292/201 |
| 5,295,720 | 3/1994 | Budde | 292/341.16 |

*Primary Examiner*—Peter M. Cuomo
*Assistant Examiner*—Gary Estremsky
*Attorney, Agent, or Firm*—Herbert Dubno; Andrew Wilford

[57] ABSTRACT

A motor-vehicle door latch for use in combination with a door bolt has a housing formed with a laterally open recess in which the bolt is receivable and a pivotal latch fork formed with a fork seat and with at least one detent and pivotal on the housing between locked, semilocked, and unlocked positions. A support link pivotal on the housing carries a latch pawl pivotal in the locked and semilocked positions of the fork into and out of a holding position engaging the detent and preventing pivoting of the fork into the unlocked position. A crank is rotatable adjacent the fork between an outer position relatively far from the fork and an inner position relatively close to the fork and through an open-ready intermediate position between the inner and outer positions and close to the outer position. This crank is connected by a link to the support link for pivoting the support link and retaining pawl as the crank rotates. A stop on the housing engages a tooth of the pawl in the intermediate and outer positions of the crank, is out of engagement with the tooth in the inner position, and is positioned such that on displacement of the crank from the open-ready intermediate to the outer position the stop pivots the pawl out of engagement with the fork.

4 Claims, 5 Drawing Sheets

POWER-ASSIST MOTOR-VEHICLE DOOR LATCH

FIELD OF THE INVENTION

The present invention relates to a motor-vehicle door latch. More particularly this invention concerns such a latch provided with a motor for power-assisted closing and/or opening.

BACKGROUND OF THE INVENTION

A power-assisted motor-vehicle door latch as described in commonly owned U.S. Pat. No. 4,892,339 has a housing formed with a laterally open recess in which the bolt is receivable, a latch fork formed with a fork seat and with at least one detent, and a fork pivot on the housing supporting the fork for pivoting between a locked and a semilocked position with the seat directed vertically away from the fork pivot and the bolt engaged in the seat and an unlocked position permitting the bolt to enter and exit the seat and recess. An operating plate pivotal on the housing about an axis substantially parallel to the fork pivot carries the pivot of a latch pawl which is pivotal on the link plate into and out of a position engaging the detent and thereby retaining the fork in the semilocked position. A motor connected to the operating plate can pivot same about its axis and, when the pawl is engaged with the detent, pivot the fork into the locked position. A door handle and a link connected between the handle and the pawl can pivot same out of engagement with the detent in any position of the fork.

Thus with this system the operating plate is pivoted to power-close the door, thereby pivoting the pawl and using this pawl to push the fork around into the fully locked position. The user of the latch need merely push the door into the semilocked position; the motor will take over from here and pull the door fully into the locked position.

Such an arrangement therefore moves through four positions: open, ready to latch, latched, and ready to open, and must move through them sequentially. Once the door is latched and it is to be opened by its motor, which is typical for a trunk lid or door, the mechanism must laboriously move through the ready-to-open position to the open position, entailing some delay. It is possible to avoid this by providing a separate actuator or motor to open the latch, but this increases the cost of the system intolerably.

OBJECTS OF THE INVENTION

It is therefore an object of the present invention to provide an improved power-assist motor-vehicle door latch.

Another object is the provision of such an improved power-assist motor-vehicle door latch which overcomes the above-given disadvantages, that is which can open and close the door rapidly and immediately.

SUMMARY OF THE INVENTION

A motor-vehicle door latch for use in combination with a door bolt has according to the invention a housing formed with a laterally open recess in which the bolt is receivable and a pivotal latch fork formed with a fork seat and with at least one detent and pivotal on the housing between a locked engaged around the bolt and holding it deep in the recess, a semilocked position engaged around the bolt and holding it shallowly in the recess, and unlocked position permitting the bolt to move into and out of the recess. A support link pivotal on the housing carries a latch pawl pivotal in the locked and semilocked positions of the fork into and out of a holding position engaging the detent and preventing pivoting of the fork into the unlocked position. The pawl is formed with a laterally projecting actuation tooth. A crank is rotatable adjacent the fork between an outer position relatively far from the fork and an inner position relatively close to the fork and through an open-ready intermediate position between the inner and outer positions and close to the outer position. This crank is connected by a link to the support link for pivoting the support link and retaining pawl as the crank rotates. A stop on the housing engages the tooth in the intermediate and outer positions of the crank, is out of engagement with the tooth in the inner position, and is positioned such that on displacement of the crank from the open-ready intermediate to the outer position the stop pivots the pawl out of engagement with the fork. When the pawl is engaged with the detent in the semi-locked position of the fork and inner position of the crank, a motor connected to the crank pivots the crank into the intermediate position and the fork into the locked position and thereafter pivots the crank into the outer position and simultaneously pivots the pawl out of the holding position. An operating lever connected to the pawl pivots same out of engagement with the detent.

The invention is based on the recognition that in a power-assist latch of the prior-art type a portion of the crank travel can be used to actuate the retaining pawl, simply by providing an actuating nose on the pawl and a stop on the latch housing that contact in the open-ready position of the crank. Thus as soon as the crank starts to move toward the open position, the pawl is pulled back and the latch is open. The rest of the travel of the pawl to the inner position can take place when the door is open, when there is plenty of time for this action.

The operating lever according to the invention is provided with a link having an elongated slot and the pawl has a coupling pin engaged in the slot. In addition the pawl has an outer end engageable with the detent and an inner end pivoted on the support link and formed with the actuation tooth. The operating lever includes two relatively pivoted lever parts.

BRIEF DESCRIPTION OF THE DRAWING

The above and other objects, features, and advantages will become more readily apparent from the following description, reference being made to the accompanying drawing in which.

SPECIFIC DESCRIPTION

Figure 1:
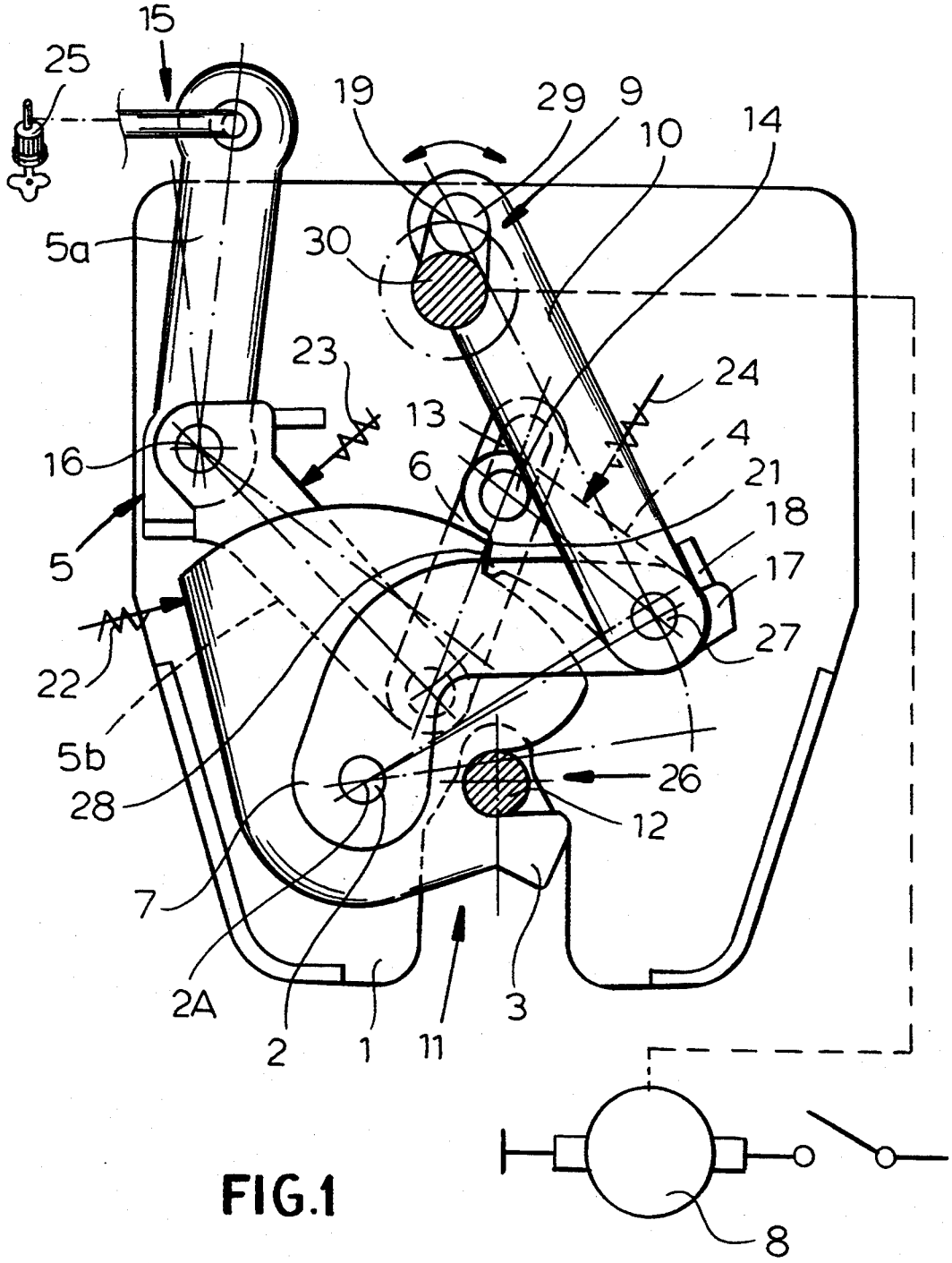
FIG. 1 is a partly diagrammatic and partly sectional side view of the latch according to this invention in the open-ready position.

As seen in FIG. 1 a latch has a housing 1 normally fixed on the edge of a vehicle door or trunk lid and provided with a latch fork 3 that is mounted on a pivot 2 defining a pivot axis 2A that is normally perpendicular to the housing 1. The housing 1 is formed with an outwardly horizontally open notch 11 in which can engage a latch bolt 12 that itself has an enlarged head and that is fixed on the edge of the door opening or post. A spring illustrated diagrammatically at 22 normally urges the fork 3 clockwise. This fork 3 is formed with a seat 26 into which the bolt 12 can fit.

A support link 7 pivotal about the axis 2A on the pivot 2 has an outer end provided with a pivot pin 27 on which is pivoted a latch pawl 4 and an operating link 10. The latch pawl 4 has a tooth 28 engageable with a detent 21 formed on the fork 3 and at its opposite end has another laterally projecting actuation tooth 17 engageable with a fixed stop or abutment 18 on the housing 1. A spring 24 biases the latch pawl 4 toward the fork 3. The operating link 10 has an end opposite the pin 27 connected via a pin 29 to a crank 9 carried on a shaft 30 of a motor 8. The pivot pin 29 can be moved by the motor 8 between an outermost position 19 (FIG. 2) with the shaft 30 between it and the fork 3 and, 180° offset therefrom, an inner position 20 (FIGS. 4 and 5) between the shaft 30 and the fork 3.

An outside door cylinder 25 is connected via a coupling rod 15 to a operating lever 5 pivoted at 16 on the housing 1. The operating lever 5 is formed by two separate levers **5*a* and 5*b* that rotate together when the lever 5*a* is pivoted counterclockwise, but which permits clockwise pivoting of the lever 5*b* independently of the lever 5*a*. The lever 5*b* has an outer end pivoted to yet another link 6 having an end formed with a slot 13 in which engages a pin 14 carried on the outer end of the pawl 4. Thus if the lever assembly 5*a* is pivoted somewhat clockwise against the force of a spring 23, the latch pawl 4 will be pushed back to disengage its tooth 28 from the detent 21. The slot 13 permits the latch pawl 4 to be pivoted into this freeing position without actuation of the lever assembly 5. In fact the cylinder 25 can move the latch pawl 4 into the freeing position in virtually any angular position of the support link plate 7**.

The latch described above operates as follows:

As seen in FIG. 1 in which the latch is in the fully locked position but is ready to open, the crank 9 is in an intermediate position immediately adjacent the outer position 19, and the latch pawl 4 has its tooth 28 engaged under the detent 21 and its actuation tooth 17 just barely engaging the abutment 18. The bolt 12 is solidly held in the recess 26. Clearly in this position if the cylinder 25 is actuated to pivot the operating lever 5 counterclockwise the pin 14 will be pushed up to push the latch pawl 4 into the freeing position and allow the fork 3 to pivot and release the bolt 12.

Figure 2:
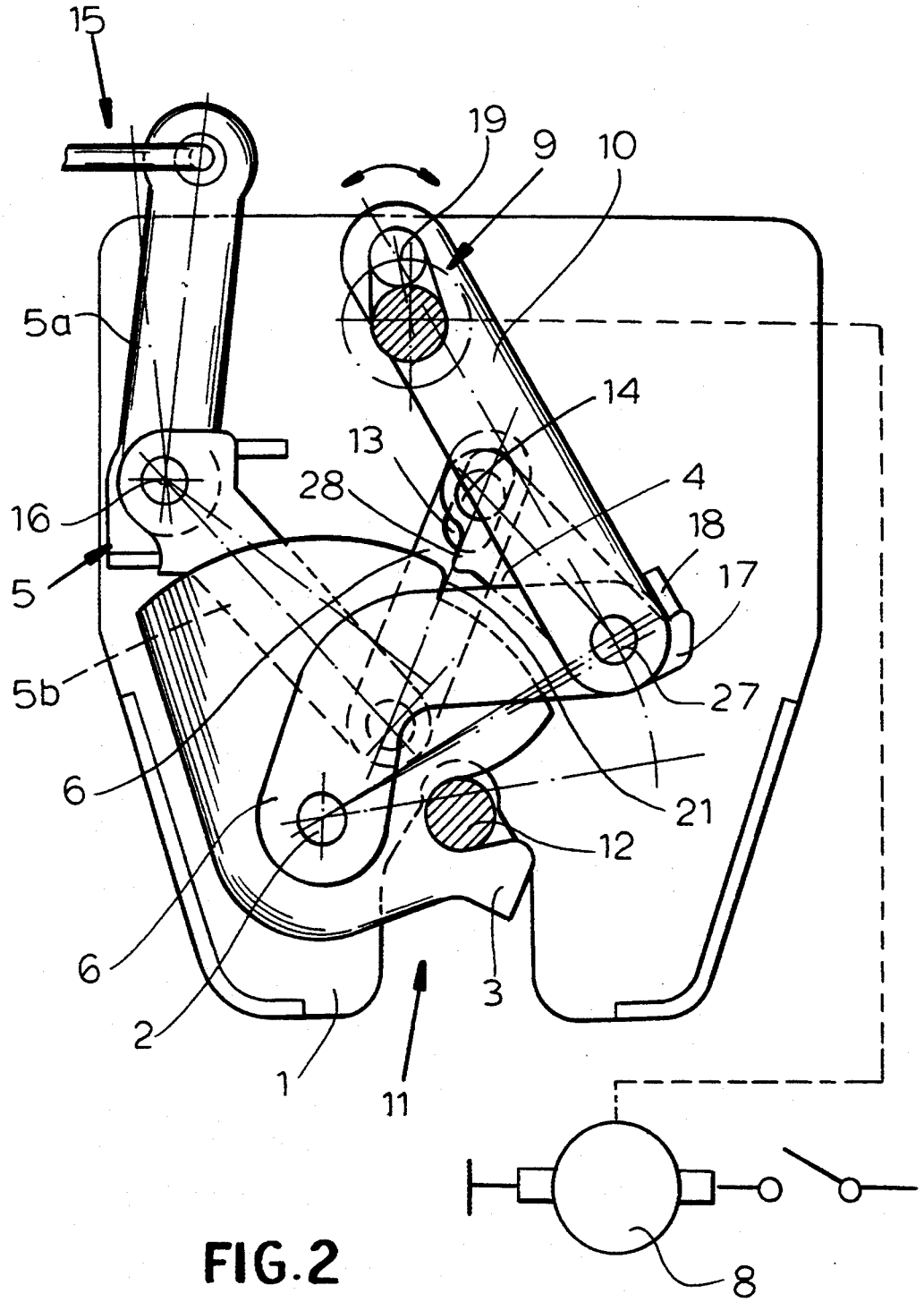
FIGS. 2, 3, 4, and 5 are views like FIG. 1 but with the latch in the released, fully open, close-ready, and closed positions, respectively.
Figure 3:
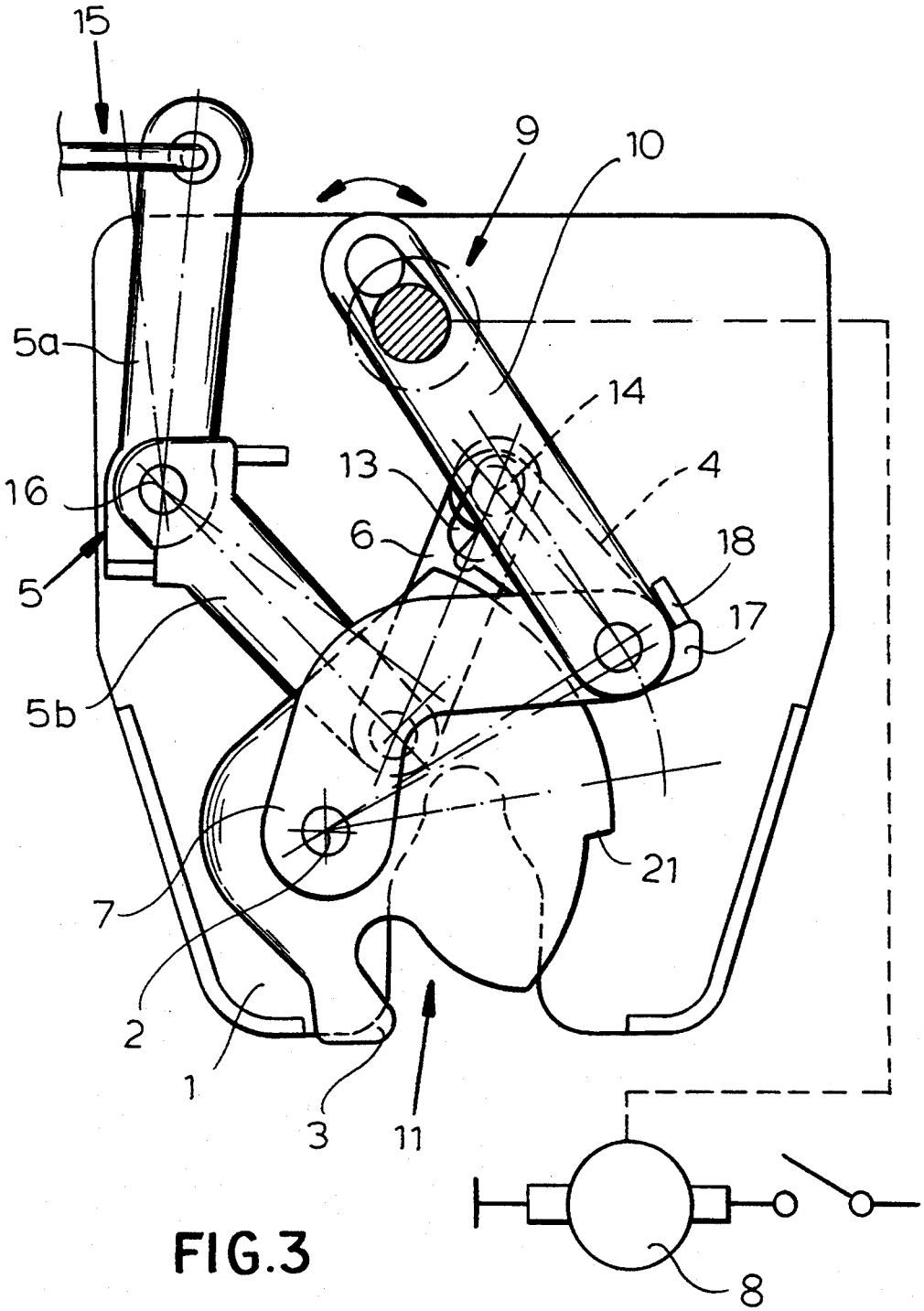

Slight counterclockwise rotation of the crank 9 into the outer position 19 as shown in FIG. 2 moves the pivot 27 of the link 10 relative to the stop 18 so that the latch pawl 4 is cammed out into the releasing position in which the fork 3 is free to pivot out and release the bolt. Meanwhile the crank 9 continues to turn so that the parts assume the position of FIG. 3, with the bolt 12 completely out of the latch.

Figure 4:
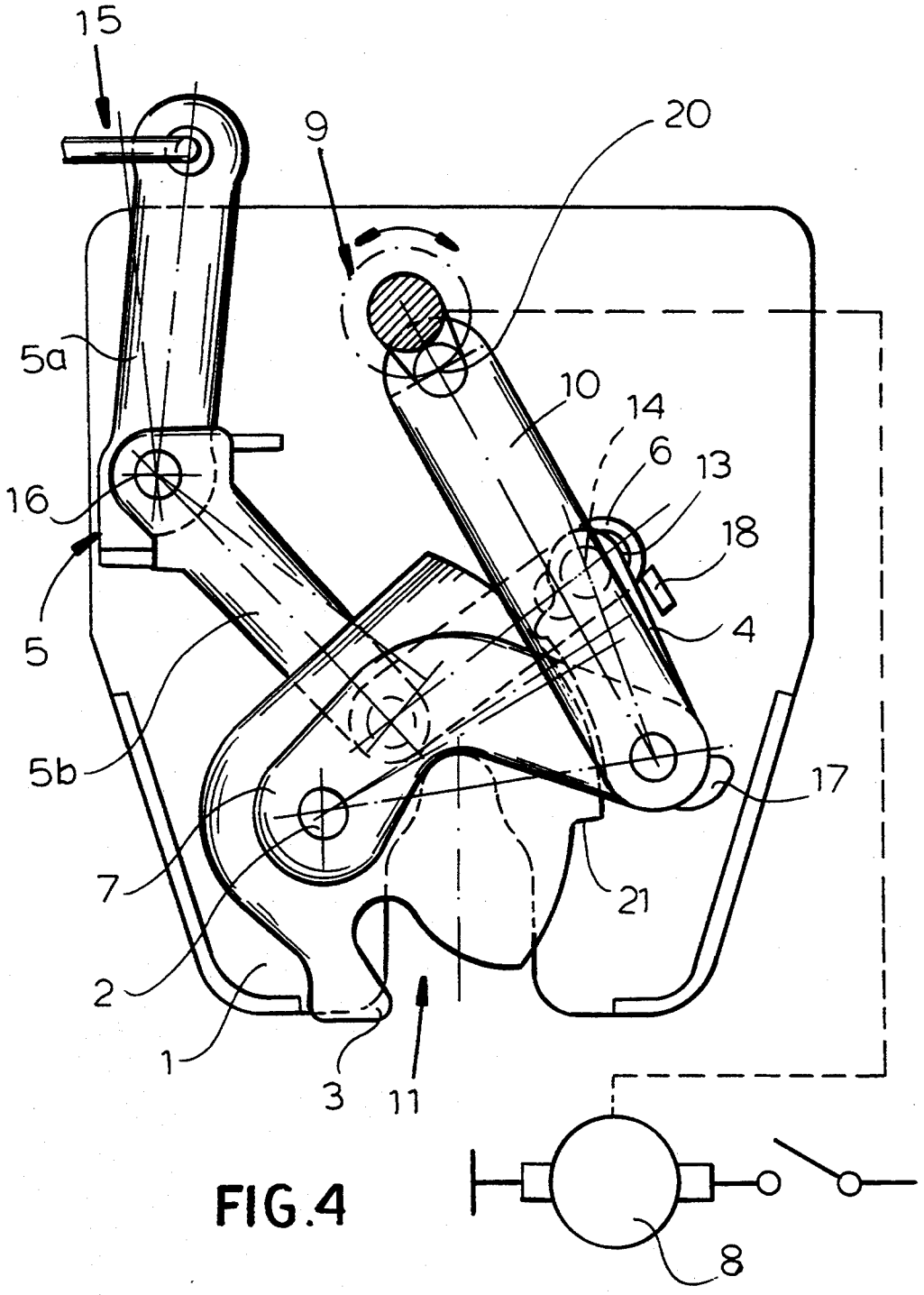
Figure 5:
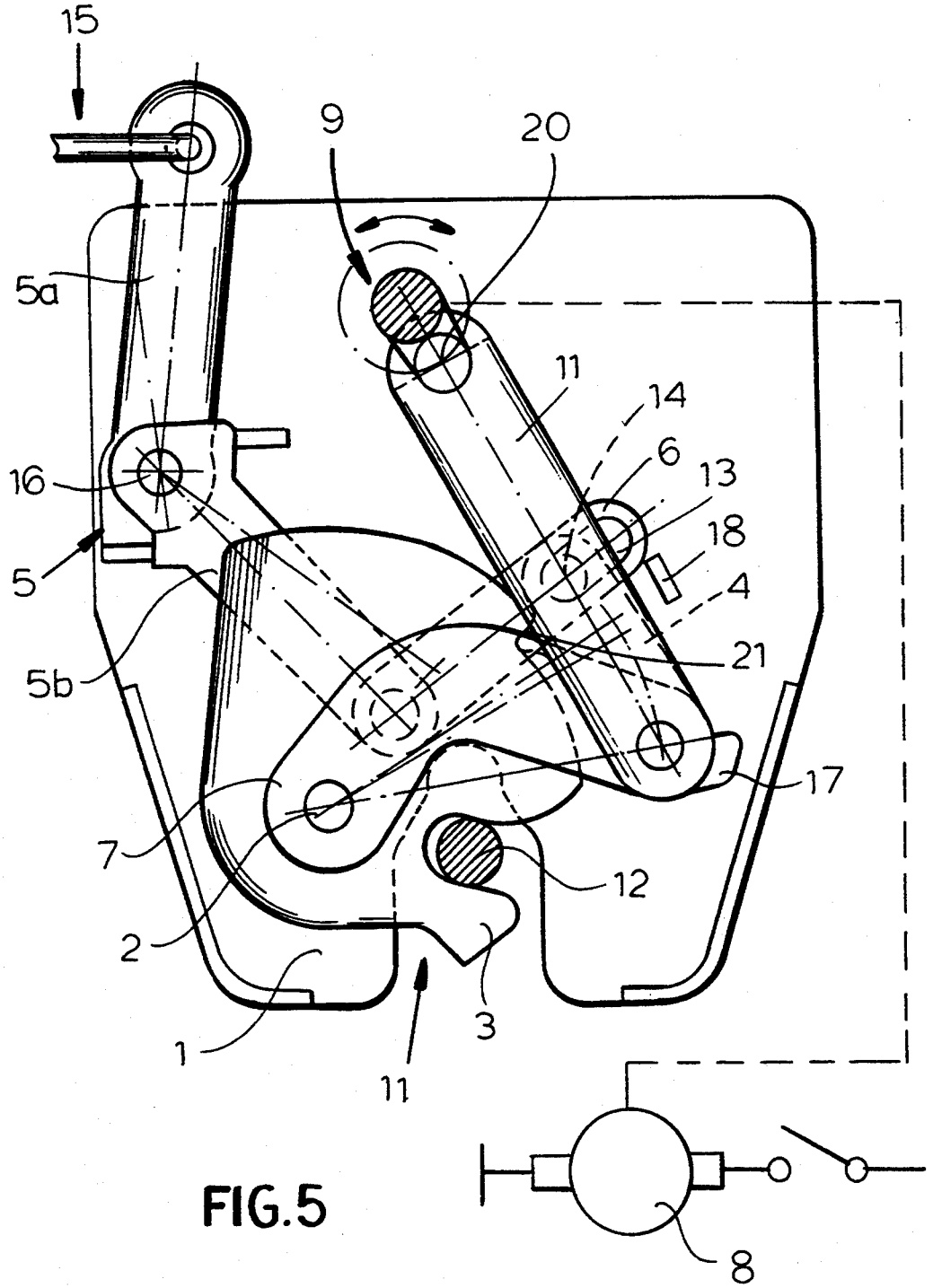

Once the crank 9 has moved into the inner position 20 as shown in FIG. 4 the lock is ready to close. Displacement of the bolt 12 into the cutout 11 causes the fork 3 to pivot into the FIG. 5 position with the tooth 28 engaged on the detent 21 and the system in a semilocked position. From this position clockwise rotation of the crank 9 back simultaneously pivots the fork 3 and latch pawl 4 to the fully locked and open-ready position of FIG. 1.

What is claimed is:

1. A motor-vehicle door latch for use in combination with a door bolt, the latch comprising:

a housing formed with a laterally open recess in which the bolt is receivable;

a pivotal latch fork formed with a fork seat and with at least one detent and pivotal on the housing between a locked engaged around the bolt and holding it deep in the recess, a semilocked position engaged around the bolt and holding it shallowly in the recess, and unlocked position permitting the bolt to move into and out of the recess;

a support link pivotal on the housing;

a latch pawl pivotal on the support link in the locked and semilocked positions of the fork into and out of a holding position engaging the detent and preventing pivoting of the fork into the unlocked position, the pawl being formed with a laterally-projecting actuation tooth;

a crank rotatable adjacent the fork between an outer position relatively far from the fork and an inner position relatively close to the fork and through a open-ready intermediate position between the inner and outer positions and close to the outer position;

means coupling the crank to the support link for pivoting the support link and retaining pawl as the crank rotates;

a stop on the housing engaging the actuation tooth in the intermediate and outer positions of the crank, out of engagement with the actuation tooth in the inner position, and positioned such that on displacement of the crank from the open-ready intermediate to the outer position the stop pivots the pawl out of engagement with the fork;

means including a motor connected to the crank for, when the pawl is engaged with the detent in the semilocked position of the fork and inner position of the crank, pivoting the crank into the intermediate position and the fork into the locked position and for thereafter pivoting the crank into the outer position and simultaneously pivoting the pawl out of the holding position; and an operating lever connected to the pawl for pivoting same out of engagement with the detent.

2. The motor-vehicle door latch defined in claim 1 wherein the operating lever is provided with a link having an elongated slot, the pawl having a coupling pin engaged in the slot.

3. The motor-vehicle door latch defined in claim 1 wherein the pawl has an outer end engageable with the detent and an inner end pivoted on the support link and formed with the actuation tooth.

4. The motor-vehicle door latch defined in claim 1 wherein the operating lever includes two relatively pivoted lever parts.

* * * * *